US008336462B2

(12) United States Patent
Danon et al.

(10) Patent No.: US 8,336,462 B2
(45) Date of Patent: Dec. 25, 2012

(54) AUTONOMOUS OPERATION OF A NON-LETHAL PROJECTILE

(75) Inventors: Haim Danon, Kiriat Ono (IL); Ilan Shalev, Givataim (IL)

(73) Assignee: SDI - Security Device International Inc., Bney Braq (IL)

( * ) Notice: Subject to any disclaimer, the term of this patent is extended or adjusted under 35 U.S.C. 154(b) by 304 days.

(21) Appl. No.: 12/408,786

(22) Filed: Mar. 23, 2009

(65) Prior Publication Data

US 2011/0001619 A1 Jan. 6, 2011

Related U.S. Application Data

(60) Provisional application No. 61/038,761, filed on Mar. 23, 2008.

(51) Int. Cl.
*F42B 30/00* (2006.01)

(52) U.S. Cl. ..... 102/502; 102/512

(58) Field of Classification Search ..... 102/502, 102/512

See application file for complete search history.

(56) References Cited

U.S. PATENT DOCUMENTS

| | | | | |
|---|---|---|---|---|
| 5,831,199 | A * | 11/1998 | McNulty et al. | 89/1.11 |
| 5,936,183 | A * | 8/1999 | McNulty, Sr. | 89/1.11 |
| 6,209,461 | B1 * | 4/2001 | Riffet et al. | 102/513 |
| 6,892,983 | B2 * | 5/2005 | Kneisl | 244/118.5 |
| 7,530,315 | B2 * | 5/2009 | Tepera et al. | 102/393 |
| 2009/0084284 | A1 * | 4/2009 | Martinez et al. | 102/504 |
| 2010/0300320 | A1 * | 12/2010 | McGarraugh et al. | 102/439 |
| 2011/0120335 | A1 * | 5/2011 | Fullerton | 102/335 |

* cited by examiner

*Primary Examiner* — Samir Abdosh

(74) *Attorney, Agent, or Firm* — The Law Office of Michael E. Kondoudis

(57) ABSTRACT

A method for incapacitating an object using a non-lethal projectile equipped with a motion sensing device. The non-lethal projectile is fired at and preferably attaches to the object. Motion of the object is monitored by the motion sensing device. Upon sensing motion of the object, the non-lethal projectile provides a first or another incapacitating stimulus to the object if the motion is sensed as meeting at least one criterion. The criterion may be based on a previously determined algorithm or the threshold is previously determined.

16 Claims, 4 Drawing Sheets

ELECTRIC ROUND - EXTERNAL VIEW
ARMS RETRACTED

ELECTRIC ROUND - EXTERNAL VIEW
Activated

AUTONOMOUS OPERATION OF A NON-LETHAL PROJECTILE

CROSS REFERENCE TO RELATED APPLICATION

The present application claims the benefit of U.S. provisional patent application 61/038,761, filed 23 Mar. 2008 by the present inventors, which is incorporated by reference.

BACKGROUND

1. Field

The present invention relates to a stun projectile system and method. More specifically, the present invention relates to non-lethal incapacitation of a target: human being, animal or vehicle.

2. Discussion of Related Art

Increasing attacks on unarmed civilian targets around the world have put law enforcement officials in a difficult position. It is necessary to quickly and effectively stop criminals and terrorists and avoid civilian injury, but terrorists are hard to distinguish from innocent civilians. Therefore, in order to stop criminals and terrorists quickly before they can cause devastating damage, some police forces have adopted a "shoot them in the head" policy. Obviously, such a policy can lead to civilian casualties and controversy. On the other hand, caution in such cases may lead to civilian casualties as well as the death of the arresting officer. Also police often desire to apprehend a suspect who is fleeing.

Therefore law enforcement officials seek a non-lethal weapon that can stop a criminal or terrorist without endangering innocent civilians. One such weapon, currently popular, is commercialized under the trademark TASER gun disclosed in U.S. Pat. Nos. 3,803,463 and 4,253,132. Improvements to the weapon have been disclosed in U.S. Pat. No. 5,654,867 and U.S. Pat. No. 6,636,412. The TASER gun shoots two darts with barbed electrodes connected to by wires to the gun body. The wires supply a pulsed electrical potential between the two darts. When both darts hit a target, the barbed electrodes penetrate skin or clothing. An electric circuit is closed and current flows through the target between the electrodes, incapacitating the target.

A non-lethal projectile as disclosed in international patent application WO2007/008923, assigned to the Applicant, includes the following characteristics:

a. minimal trauma is delivered to the individual;
b. wireless (or tetherless which means not requiring a wire attachment to a stationary power source);
c. self powered;
d. fired from a standard or non-standard weapon
e. ballistic performance similar to standard ammunition;
f. may be stored and handled safely like standard ammunition;
g. may be stored for long time periods (on the order of years); and
h. can be adapted to different calibers.

The terms "individual", "object" and "target" as used herein interchangeably refer to the person, animal or vehicle being incapacitated. The term "stimulus" refers to an electrical shock, biochemical agent or other method used for incapacitation.

BRIEF SUMMARY

According to an aspect of the present invention, there is provided a method for incapacitating an object using a non-lethal projectile equipped with a motion sensing device. The non-lethal projectile is fired at and preferably attaches to the object. Motion of the object is monitored by the motion sensing device. Upon sensing motion of the object, the non-lethal projectile provides a first or another incapacitating stimulus to the object a decision is made whether to provide an incapacitating stimulus to the object or not to provide the incapacitating stimulus based on the motion sensed as meeting at least one criterion. The criterion may be based on a previously determined algorithm or is a previously determined threshold.

The monitoring motion includes monitoring: a position, an orientation, a speed, a velocity, an angular position, an angular speed and/or an angular velocity. The non-lethal projectile may be provided with an audible warning output so that after the firing, the object is warned not to move using the audible warning output. The non-lethal projectile may be provided with an active signaling device and subsequent to the firing, the active signaling device may be used to warn persons in the environment of the object that the projectile is actively operating.

According to an aspect of the present invention, there is provided a non-lethal projectile including an attachment mechanism adapted for attaching the non-lethal projectile to an object, an incapacitation mechanism adapted to provide an incapacitating stimulus to the object and a motion sensing device adapted for sensing motion of the object subsequent to receiving the incapacitating stimulus. A control unit operatively attaches to the motion sensing device and to the incapacitation mechanism. The control unit based upon sensing the motion as meeting at least one criterion decides whether to signal the incapacitation mechanism to provide or not to provide an incapacitating stimulus. The non-lethal projectile may include a battery, a direct current to direct current DC/DC converter receiving power from the battery, an electronic circuit operatively attached to a power output of said DC/DC converter. The electronic circuit may be configured to provide an incapacitating electrical shock to the object. The motion sensing device may include an inertial sensor, an acceleration sensor, a vibration sensor, an orientation sensor, gyroscope, and/or a global positioning (GPS) sensor. A warning device may be attached to the control unit, the warning device is adapted to warn the object not to move. The warning device may include a loudspeaker. An active signaling device may be part of the non-lethal projectile for warning persons in the environment of the object that the projectile is actively operating. The active signaling device may include one of a light emitting diode, a laser, a mechanical or moving indicator, e.g. colored flag, color change of an element of the projectile, an audio transducer, a loudspeaker and/or a buzzer.

According to an aspect of the present invention, there is provided a method for incapacitating an object using a non-lethal projectile equipped with a battery, a direct-current to direct-current (DC/DC) converter receiving power from the battery, and an electronic circuit attached to a power output of the DC/DC converter. The electronic circuit configured for providing an incapacitating electrical shock to the object. The battery powers a control unit. A motion sensing device, an active warning device and an audio circuit are all attached to the control unit. The non-lethal projectile is equipped with an attachment mechanism adapted for attaching to the object or clothing thereof. The non-lethal projectile is fired at the object so that the attachment mechanism is intended to attach to the object. An active signal is provided to warn persons in the environment of the object that the projectile is actively operating. Upon providing an incapacitating stimulus to the object, an audible warning signal is provided to the object using the audio circuit. Motion of the object is monitored with the motion sensing device; and an (or another) incapacitating stimulus is provided to the object only if motion is sensed as meeting at least one criterion. The criterion may be based on a previously determined algorithm or a previously determined threshold.

According to another aspect of the present invention, the non-lethal projectile is provided that includes: an attachment mechanism which attaches to an object, a motion sensing device which senses motion of an object being incapacitated, and a control unit attached to the motion sensing device. Motion of the object is monitored. Upon sensing the motion, the control unit preferably compares the motion to threshold values of acceleration. The control unit optionally calculates the speed and travel of the target. The control unit decides, based on the acceleration, the calculated speed and/or travel whether to incapacitate, e.g. by delivering an electric shock. Accordingly, if the acceleration, speed or travel of the object is above the threshold values, the control unit signals another incapacitating stimulus. The threshold may be based on a previously determined algorithm or the threshold is previously determined.

The non-lethal projectile may include a warning device attached to the control unit. The warning device warns the object not to move typically with an audible warning signal. In this way, additional shocks are avoided. The warning device preferably uses an audio circuit and loudspeaker attached to the control unit.

The non-lethal projectile may include an active signaling device attached to the control unit. The active signaling device warns the surrounding environment, e.g., citizens and/or law enforcement officers that the projectile is active so that any persons in the surrounding environment should avoid touching the object and endanger themselves of incapacitation. The active signaling device preferably includes an audible signal and/or a warning light.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
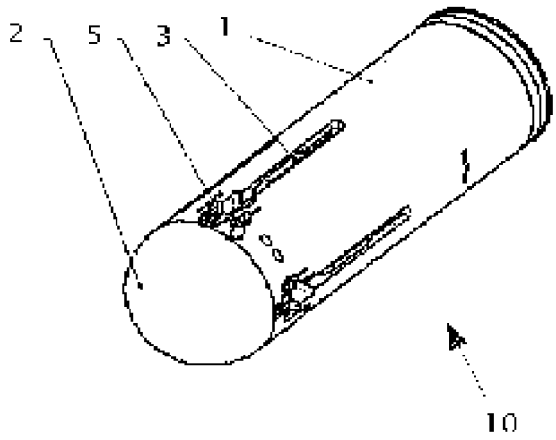
Fig. 1 Prior Art
FIG. 1 is a perspective view of a conventional wireless projectile (electric round) similar to that disclosed in Patent Application WO2007/008923.

Reference will now be made in detail to embodiments of the present invention, examples of which are illustrated in the accompanying drawings, wherein like reference numerals refer to the like elements throughout. The embodiments are described below to explain the present invention by referring to the figures.

Before explaining embodiments of the invention in detail, it is to be understood that the invention is not limited in its application to the details of design and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

It should be further noted that the principles of the present invention are equally applicable across a full range of non-lethal weapons including non-lethal weapons which incapacitate by electrical shock, tethered or tetherless and/or biochemical agents. While the discussion herein is directed toward application of embodiments of the present invention to a tetherless projectile, the principles of the present invention may be readily adapted for use with a tethered projectile and/or incapacitation by administration of biochemical agents.

Figure 2:
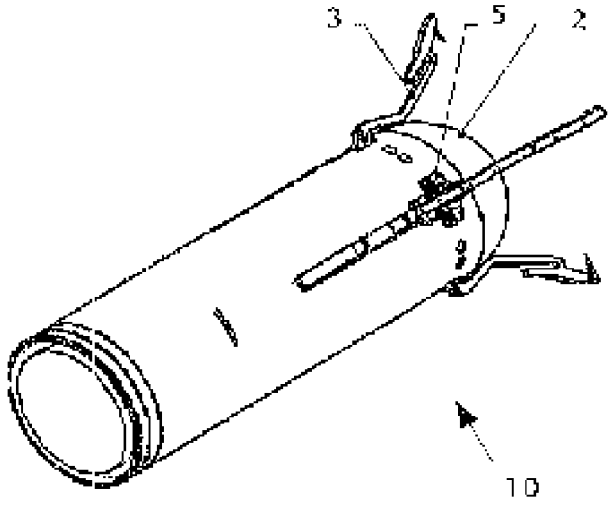
Fig. 2 Prior Art
FIG. 2 is a perspective view of the conventional wireless projectile (electric round) of FIG. 1. in an activated condition in which arms are extended.

Referring now to the drawings, FIGS. 1 and 2 illustrates a wireless projectile 10 similar to that previously disclosed by the Applicants in WO2007/008923. Shown in FIGS. 1 and 2 is a projectile body 1. FIG. 1 illustrates projectile 10 prior to firing and FIG. 2 illustrates projectile 10 subsequent to firing. Projectile body 1 is typically hollow and houses active elements within. Slits 5 in the side of projectile body 1, may serve as passageways through which spider arms 3 spring out and are deployed upon impact with a target. Spider arms 3 may serve as an attachment mechanism, to secure the projectile to a target after impact.

Projectile 10 may be fired at a range of 10-50 meter without killing. The electrical round may be quite heavy Therefore in order to avoid permanent injury at such short ranges, energy of impact is preferably absorbed by energy absorbing elements, for instance projectile head 2 so that the target is not injured by the inertial impact of the projectile by projectile head 2 which is preferably deformable as disclosed in co-pending U.S. application Ser. No. 12/059,064 entitled "Non-lethal Projectile" by the present inventors.

Projectile 10 includes a battery (not shown) which is the only source of power. Projectile 10 is safe while in a cartridge. Inside the cartridge, an electrical switch (not shown) which connects the battery to the electrical circuit is off. Arms 3 which function as electrodes are folded inwards within the cartridge. Projectile 10 is loaded into the rifle or grenade launcher. When shot, projectile 10 accelerates within the barrel. Upon leaving the barrel, rear fins (stabilizers) optionally unfold. Projectile 10 travels to the target and hits the target. The inertial impact causes closure of the switch connecting the battery to the circuit and at the same time the arms (electrodes) unfold and the target is caught by the penetrating hooks of the electrodes. The target is incapacitated by cycles of electric pulses at a rate of about 10-30 pulses per second (PPS) during a period of 2-10 seconds. There is optionally a waiting period of 0 to 10 seconds (or longer) and electric pulses are subsequently resumed. The electric pulse includes first a high voltage peak to ionize an air gap (if an air gap exists) between electrode and target. The peak voltage is typically 10,000 to 80,000 volts peak with duration of 3-10 microseconds. The peak voltage is preferably load dependent so that when the air gap ionizes the voltage lowers to 300-1500 volt with typical current on 0.5-1.5 Ampere for 100-200 microseconds. The voltage pulses have repetition rate of 10-30 PPS. Each electric pulse is less than 0.1 joules. Time of operation is 20 seconds to few minutes, e.g., 5 minutes, which is a predetermined duration that depends on the projectile range and is limited by the battery charge and clinical issues.

Figure 3:
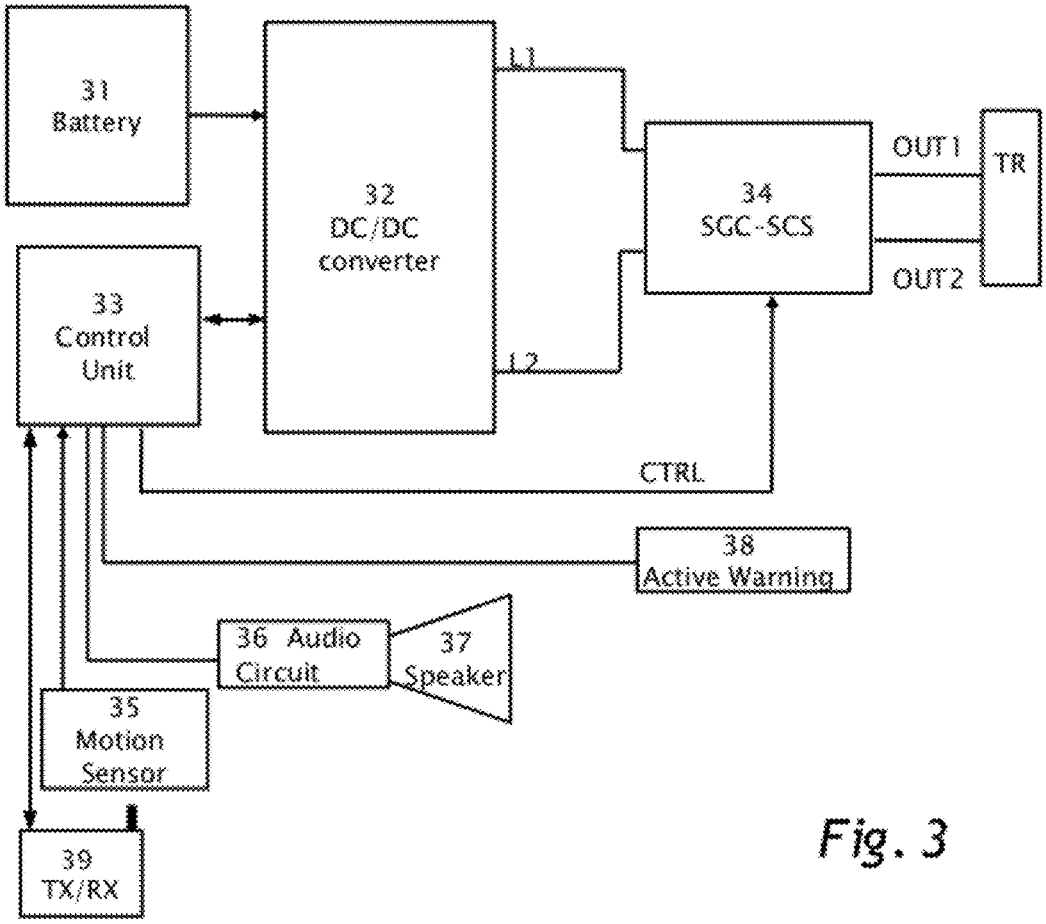
FIG. 3 is a simplified electronic block diagram of a projectile according to an embodiment of the present invention.

Reference is now made to FIG. 3, illustrating a simplified block diagram of an electronic circuit, according to an embodiment of the present invention. On attaching to the target, a battery 31 is connected to a DC-DC converter 32 controlled by a control circuit. The output of the DC-DC converter 32 feeds, via L1 and L2, a pulse (or spark) generating circuit (SGC) and stunning current supply (SCS), SGC-SCS 34. SGC-SCS 34 is controlled by control unit 33 via line CTRL. Electrical connections OUT1 and OUT2 between the SGC-SCS 34 and the target TR include electrodes/arms 3 and may include one or more non-conducting gaps through air and/or clothing. The gaps are preferably ionized by the high voltage pulse generated by, for instance, a single capacitive discharge in SGC-SCS 34 with the same single capacitive discharge providing current for stunning target TR to pass from the SGC-SCS 34 to target TR. Examples of electronic circuitry included in SGC-SCS 34 is disclosed in a co-pending U.S. application Ser. No. 12/169,729.

A motion sensor 35 which senses motion, is connected to control unit 33. Motion sensor 35 may include an inertial sensor, an acceleration sensor, a vibration sensor, an orientation sensor, gyroscope, and/or a global positioning (GPS) sensor using any means known in the art of sensing motion, position, orientation, speed, velocity, angular position and/or angular velocity sensing. Motion sensor 35 provides data that enables identifying target TR changing position and/or orientation and rates of the changes of position/orientation.

An audio circuit 36 with a speaker 37 is optionally attached to control unit 33. Audio circuit 36 operates to warn the target prior to administer a or another incapacitation stimulus or shock.

An active warning mechanism 38 is optionally attached to control unit 33 to alert that attached projectile 10 is active and for surrounding persons not to touch target TR. The active signal 38 is a visible warning signal, an audio signal or buzzer or warning light (e.g. light emitting diode, or laser or a mechanical or moving indicator, e.g. colored flag,) activated by control unit 33, for instance, for a predetermined duration during operation of the projectile.

According to a further feature of the present invention, a wireless transmitter and/or receiver unit 39 may be attached to control unit 33. Wireless unit 39 enables transmitting to a law enforcement officer information regarding the event for instance for recording the event (as evidence if necessary to present at a hearing), and/or for remote controlling the incapacitation function of the projectile based on data received remotely from motion sensor 35. A commanding officer may not have visual contact with the target and based on data from motion sensor 35 received remotely, the commanding officer may choose to initiate remotely another incapacitation pulse or not to do so; or control the power/duration of the incapacitation.

Operation of projectile 10, according to an embodiment of the present invention may proceed as follows. Upon a command from control unit 33, DC-DC converter 32 starts, feeding the operating supply voltage to SGC-SCS 34. The timing of the output high voltage and current pulses for incapacitation is determined by control unit 33. At the required instant, control unit 33 signals the generation of the pulse by SGC-SCS 34 by sending a command signal via CTRL. In response SGC-SCS 34 generates a very high voltage (in the range of tens of kilo volts) combined with a lower voltage, in the range of few hundreds volts. The high voltage portion of the signal breaks down existing non-conducting paths between the output of SGC-SCS 34 and target TR thereby completing the electrical connection between the low voltage source within SGC-SCS 34 and the target. Spark generation and high voltage circuits known in the art of electronics may be applied to the present invention as are found in diverse applications, e.g., automotive spark plugs, discharge lamp ballasts.

Figure 4:
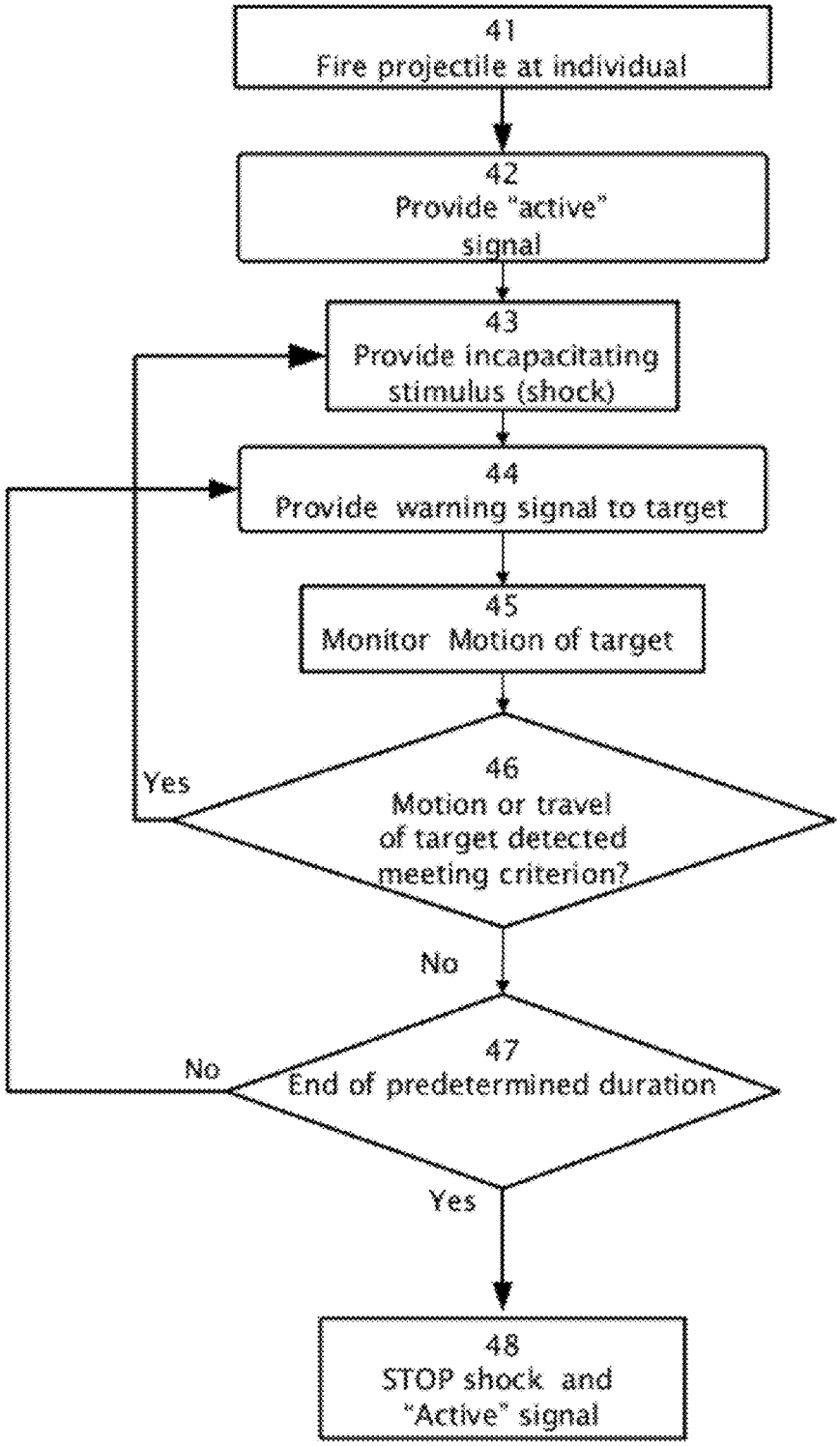
FIG. 4 is a block diagram (flowchart) of a method of sensing motion of a target and incapacitating the target, according to an embodiment of the present invention.

Reference is now made to FIG. 4, a simplified flow diagram of a method of operation of projectile 10, according to an embodiment of the present invention. A law enforcement office, for instance fires (step 41) projectile 10. Projectile 10 preferably attaches to target. An additional feature of various embodiments of the present invention includes autonomous active signaling (step 42) to warn the citizens and law enforcement in the environment not to touch or approach target TR because projectile 10 is still active and may deliver an or another incapacitating stimulus (step 43). Typically an incapacitating shock (step 43) is delivered followed by a warning signal provided (step 44) to target TR.

Motion sensor 35 monitors (step 45) and senses motion of the target, e.g., the object changes position or starts walking or running Motion sensor 35 signals are input to control unit 33. On sensing motion meeting criteria typically based on a previously determined algorithm, (decision box 46) indicating that target TR is trying to move, control unit 33 optionally autonomously initiates another immediate incapacitating shock (step 43) by signaling SGC-SCS 34 to generate high voltage and current pulses for incapacitation of the object.

A threshold may be derived from a previously determined algorithm that determines according to information collected during the event up to that moment. Information includes parameters such as motion data as detected by motion sensor 35, incapacitation data, object time between detected movements by the target and/or history of the event.

An additional feature of various embodiments of the present invention includes autonomous operation of the projectile without requiring a law enforcement officer to warn the person not to move. According to this feature, control unit 33 is attached to audio circuit 36 and loudspeaker 37. A warning signal is generated such as a "Don't Move" audible signal, from loudspeaker 37 and if (further) motion of the target TR is sensed, i.e. the person is ignoring the audible warning then control unit 33 signals another incapacitating stimulus (step 43). Otherwise, if the person doesn't move above the threshold (decision box 46) control circuit 33 waits and does not provide any additional incapacitating stimuli. Preferably, the warning signal is provided before, e.g., 2-3 seconds before the first incapacitation stimulus is provided thereby giving the object at option to avoid the pain of the stimulus. In step 47, when target TR moves less than the threshold, or stops moving and a predetermined duration has been reached, (step 47) the incapacitation is disabled and the active warning signal is shut down (step 48), enabling law enforcement to safely approach target TR.

According to features of various embodiments of the present invention, the wireless projectile is shot 10-50 meters in order to incapacitate the object. Compared to for instance a tethered projectile which operates typically at a distance of 5-7 meters, the wireless projectile is too distant for law enforcement officers to easily communicate with the target or others in the immediate environment of the target. Hence, autonomous operation of the projectile, according to the present invention is desired.

A feasibility test was performed using motion sensor ADXL330 Small, Low Power, 3-Axis±3 g iMEMS® Accelerometer provided by Analog Devices.

Figure 5:
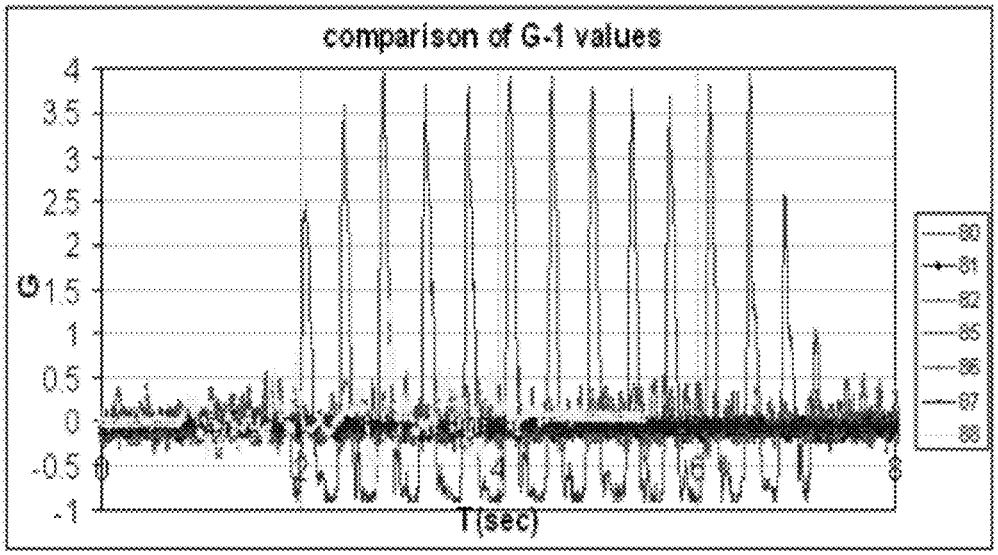
FIG. 5 is a chart of an oscilloscope output demonstrating differences between running and various other movements of a target.

The ADXL330 sensor measures acceleration in 3 axes and sufficiently sensitive to slow human movements found to be less than 2 g. A test was performed to validate the applicability of using the ADXL330 accelerometer. The accelerometer was attached to a person and the accelerometer output was connected to an oscilloscope. The oscilloscope output is shown in the graph of FIG. 5. The data as graphed demonstrate a significant difference between running (high peaks) and various other movements of the target moving from its place.

Although embodiments of the present invention have been shown and described, it is to be appreciated that variations, modifications, and other applications may be made to these embodiments without departing from the principles and spirit of the invention, the scope of which is defined in the claims and their equivalents.

What is claimed is:

1. A method for incapacitating an object using a non-lethal projectile, wherein the non-lethal projectile includes a control unit attached to a motion sensing device and an incapacitation mechanism, the method comprising the steps of:

firing the non-lethal projectile at the object;

upon the non-lethal projectile attaching to the object, sensing motion of the object by the motion sensing device; and deciding whether to provide an incapacitating stimulus to the object or not to provide said incapacitating stimulus based on the motion sensed as meeting at least one criterion, wherein said deciding is performed by the control unit, and said incapacitation stimulus is provided by the incapacitation mechanism.

2. The method according to claim 1, wherein said at least one criterion is based on a previously determined algorithm.

3. The method according to claim 1, wherein said at least one criterion is a previously determined threshold.

4. The method according to claim 1, wherein said sensing motion includes monitoring at least one of a position, an orientation, a speed, a velocity, an angular position, an angular speed or an angular velocity.

5. The method according to claim 1, further comprising:

providing the non-lethal projectile with an audible warning output; and warning the object not to move after said firing with said audible warning output.

6. The method according to claim 1, further comprising:

providing the non-lethal projectile with an active signaling device; and subsequent to said firing, using said active signaling device for warning persons in the environment of the object that the projectile is actively operating.

7. A non-lethal projectile adapted for firing at an object, the non-lethal projectile comprising:

an attachment mechanism adapted for attaching the non-lethal projectile to an object;

an incapacitation mechanism adapted to provide an incapacitating stimulus to the object;

a motion sensing device adapted for sensing motion of said object upon said non-lethal projectile attaching to the object; and a control unit operatively attached to said motion sensing device and to said incapacitation mechanism, wherein, based upon said sensed motion as meeting at least one criterion, said control unit decides whether to signal said incapacitation mechanism to provide or not to provide an incapacitating stimulus.

8. The non-lethal projectile according to claim 7, wherein said motion sensing device includes at least one device selected from the group consisting of: an inertial sensor, an acceleration sensor, a vibration sensor, an orientation sensor, gyroscope, and a global positioning (GPS) sensor.

9. The non-lethal projectile according to claim 7, further comprising:

a battery;

a direct current to direct current DC/DC converter receiving power from said battery; and an electronic circuit operatively attached to a power output of said DC/DC converter, said electronic circuit configured for providing an incapacitating electrical shock to the object.

10. The non-lethal projectile according to claim 7, further comprising:

a warning device operatively attached to said control unit, said warning device adapted to warn the object not to move.

11. The non-lethal projectile according to claim 10, wherein said warning device includes a loudspeaker.

12. The non-lethal projectile according to claim 7, further comprising:

an active signaling device operatively attached to said control unit, warning persons in the environment of the object that the projectile is actively operating.

13. The non-lethal projectile according to claim 12, wherein said active signaling device is selected from the group consisting of: a light emitting diode, a laser, color change of an element of the projectile, a mechanical indicator, an audio transducer, a loudspeaker and a buzzer.

14. A method for incapacitating an object using a non-lethal projectile equipped with a battery, a direct current to direct current DC/DC converter receiving power from said battery, an electronic circuit operatively attached to a power output of said DC/DC converter, said electronic circuit configured for providing an incapacitating electrical shock to the object, wherein the battery powers a control unit, wherein a motion sensing device, an active warning device and an audio circuit are all operatively attached to the control unit, wherein the non-lethal projectile is equipped with an attachment mechanism adapted for attaching to the object, the method comprising:

firing the non-lethal projectile at the object so that the attachment mechanism attaches to the object;

providing an active signal thereby warning persons in the environment of the object that the projectile is actively operating; and upon providing an incapacitating stimulus to the object, providing an audible warning signal to the object, monitoring motion of the object with the motion sensing device, and providing another incapacitating stimulus to the object only if motion is sensed as meeting at least one criterion.

15. The method according to claim 14, wherein said meeting at least one criterion is based on a previously determined algorithm.

16. The method according to claim 14, wherein said meeting at least one criterion is previously determined.

* * * * *